US010194717B2

(12) United States Patent
Ort

(10) Patent No.: US 10,194,717 B2
(45) Date of Patent: Feb. 5, 2019

(54) BUTTON COVER DEVICE

(71) Applicant: Mordechai Ort, Lakewood, NJ (US)

(72) Inventor: Mordechai Ort, Lakewood, NJ (US)

( * ) Notice: Subject to any disclaimer, the term of this patent is extended or adjusted under 35 U.S.C. 154(b) by 0 days.

(21) Appl. No.: 15/471,938

(22) Filed: Mar. 28, 2017

(65) Prior Publication Data

US 2017/0340068 A1 Nov. 30, 2017

Related U.S. Application Data

(60) Provisional application No. 62/314,110, filed on Mar. 28, 2016.

(51) Int. Cl.

| | |
|---|---|
| ***A44B 1/14*** | (2006.01) |
| ***A44B 1/04*** | (2006.01) |
| ***A43C 11/02*** | (2006.01) |
| *A44B 1/12* | (2006.01) |
| *A41D 27/00* | (2006.01) |

(52) U.S. Cl.

CPC ..... *A44B 1/14* (2013.01); *A43C 11/02* (2013.01); *A44B 1/04* (2013.01); *A41D 27/00* (2013.01); *A44B 1/12* (2013.01)

(58) Field of Classification Search

CPC .... A44B 1/14; A44B 1/04; A44B 1/12; A43C 11/02; A41D 27/00; Y10T 24/367; Y10T 24/3672

See application file for complete search history.

(56) References Cited

U.S. PATENT DOCUMENTS

| | | | | | |
|---|---|---|---|---|---|
| 502,201 | A * | 7/1893 | Pilbeam | A44B 1/14 | 24/113 MP |
| 581,111 | A * | 4/1897 | Goodwin | A44B 1/14 | 24/113 MP |
| 2,454,103 | A * | 11/1948 | Swidersky | A44B 99/00 | 24/113 MP |
| 3,777,336 | A * | 12/1973 | Anderson | A44B 1/14 | 24/113 MP |
| 4,471,510 | A * | 9/1984 | DeRosa | A44B 1/22 | 24/114.7 |
| 5,033,168 | A * | 7/1991 | Sbragi | A44B 1/14 | 24/113 MP |

(Continued)

*Primary Examiner* — Robert Sandy
*Assistant Examiner* — Rowland Do
(74) *Attorney, Agent, or Firm* — Ruth Eure

(57) ABSTRACT

A button cover device for covering a button mounted to an object is provided. The button has an outer perimeter edge together with a top half and a bottom half. The button cover device comprises a C-shaped base component having curved first and second arms. A top component is hingedly secured to the base component and includes a cover portion and an annular ring. A first edge of the annular ring is connected to the bottom surface of the cover portion with the annular ring extending away from a bottom surface of the cover portion. Upon positioning the base component around the outer perimeter edge of the button, along the bottom half of the button, the base component is releasably secured to the button and upon folding the top component over the button, the annular ring surrounds the outer perimeter edge of the button, along the top half of the button with the top component completely covering the top half of the button.

11 Claims, 3 Drawing Sheets

(56) References Cited

U.S. PATENT DOCUMENTS

| | | | | | |
|---|---|---|---|---|---|
| 5,161,285 | A * | 11/1992 | Jerjian | A44B 1/14 | 24/113 MP |
| 5,379,611 | A * | 1/1995 | Impagliazzo | A44C 7/006 | 63/1.17 |
| 5,394,719 | A * | 3/1995 | Fang | A44B 1/14 | 24/113 MP |
| 5,621,951 | A * | 4/1997 | Gould | A44B 1/14 | 24/113 MP |
| 6,035,494 | A * | 3/2000 | Duke | A44B 1/14 | 24/113 MP |
| 6,857,167 | B2 * | 2/2005 | Bishop | A41D 25/003 | 24/113 MP |
| 7,350,274 | B2 * | 4/2008 | Rogers | A42B 1/24 | 24/113 MP |
| D712,308 | S * | 9/2014 | Weber | D11/222 | |
| 9,433,257 | B2 * | 9/2016 | Taetzsch | A44B 1/04 | |
| 2015/0216238 | A1 * | 8/2015 | Zaboyan | A41B 7/02 | 2/69 |

* cited by examiner

BUTTON COVER DEVICE

CLAIM OF PRIORITY

This patent application claims priority under 35 USC 119 (e)(1) from U.S. Provisional Patent Application Ser. No. 62/314,110 filed Mar. 28, 2016, of common inventorship herewith entitled, "Instant Redesign Button," which is incorporated herein by reference as though the same were set forth in its entirety.

FIELD OF THE INVENTION

The present invention pertains to the field of button cover devices, and more specifically to the field of button cover device providing a line of interchangeable button covers that provide individuals with a means of achieving variety and individuality within their wardrobe and décor.

BACKGROUND OF THE INVENTION

One of the most prevalent methods used by many people to assert an independent sense of self is through fashion. Even following the latest trends, whether it is casual shorts and tees or embroidered couture, individuals of all ages and particularly young people use current fashion as a direct indication of their individuality. From urban, prep and sophisticated to artsy, retro and punk, there are a plethora of different styles for fashion conscious people to mix and match or simply go with one complete look.

Another way people use fashion as a form of self-expression is through representative and popular logos. Embroidered and screen printed tee shirts and hats have everything from animal pictures, musical lyrics, mascots and athletes, all indications that point to a person's personality and interests. Other forms of expressing individuality in dress include various colors, styles, patterns, and accent accessories. Accent accessories that set a unique style on apparel are buttons which can be brightly colored, uniquely patterned and interestingly shaped to make a statement. People often remove buttons from a piece of apparel and replace them with a separate set of buttons they have selected elsewhere that appeals more to their taste and individuality.

The prior art has put forth several designs for button covers. Among these are:

US Patent Publication 2014/0109346 to Susan Michelle Barce and Keith M. Nystrom describes a decorative cover for interchangeable attachment to buttons to change the appearance of the button. The decorative cover includes a base member with a hollow bore extending through at least one end thereof and a decorative part permanently attached to an opposite end. An inner surface of the bore frictionally engages an outer edge of the button to retain the base member in place but permits it to be removed when desired. In one embodiment the base member is an elastomeric material having a durometer to enable the button to press into an inner surface of the bore. A detent is provided in the bore to engage the button to assist in holding the decorative cover in place. In another embodiment the base member is longitudinally split into two semi cylindrical segments that spread apart to enable a button to be engaged between them.

US Patent Publication 2014/0101896 to Michael T. Rowton describes a button covering system for selectively covering a button on clothing to change the aesthetics of the clothing or for advertising. The button covering system includes a cover that is removable connectable to a conventional button. The cover includes an outer portion with an outer surface, a sidewall, an inner lip defining a receiver opening and an interior cavity. One or more tabs extend inwardly from the inner lip to enhance the catchable engagement about the conventional button. The cover is comprised of a flexible and resilient material that allows for positioning over a conventional button while preventing accidental removable of the cover from the conventional button after attachment. The outer surface of the cover is comprised of various colors, designs and indicia.

US Patent Publication 2012/0240356 to Elias Nathanson describes an oval portable button cover that is placed behind an affixed button by sliding it downward. The button cover is cut out at the bottom rear center that is wide enough to allow it to slide down around the thread behind the button. The top edge of the cutout section at the rear of the button cover prevents the button from sliding through completely. As such the button and thread maintain their integrity without damage to either. The portable button cover is removed by simply sliding the button cover upward and still not damaging the button or the thread.

None of these prior art references describe the present invention.

SUMMARY OF THE INVENTION

It is an object of the present invention to provide a line of interchangeable button covers that provide individuals with a means of achieving variety and individuality within their wardrobe and décor.

The present invention is a button cover device for covering a button mounted to an object. The button has an outer perimeter edge together with a top half and a bottom half. The bottom half of the button is adjacent the object and the top half of the button is distant from the object. The button cover device comprises a C-shaped base component having a curved first arm and a curved second arm with both the first arm and the second arm have a top edge and a bottom edge. A top component is hingedly secured to the base component with the top component including a cover portion having a top surface and a bottom surface and an annular ring having a first edge and a second edge. The first edge of the annular ring is connected to the bottom surface of the cover portion with the annular ring extending in a general direction away from the bottom surface of the cover portion. Upon positioning the base component around the outer perimeter edge of the button, along the bottom half of the button, the base component is releasably secured to the button and upon folding the top component over the button, the annular ring surrounds the outer perimeter edge of the button, along the top half of the button with the top component completely covering the top half of the button.

In addition, the present invention includes a method for covering a button mounted to an object. The button has an outer perimeter edge with a top half and a bottom half. The bottom half of the button is adjacent the object and the top half of the button is distant from the object. The method comprises providing a C-shaped base component having a curved first arm and a curved second arm with both the first arm and the second arm have a top edge and a bottom edge, hingedly securing a top component to the base component with the top component having a cover portion having a top surface and a bottom surface and an annular ring having a top edge and a bottom edge, connecting the top edge of the annular ring to the bottom surface of the cover portion, extending the annular ring in a general direction away from the bottom surface of the cover portion, positioning the base component around the outer perimeter edge of the button, along the bottom half of the button, folding the top component over the button, surrounding the outer perimeter edge of the button with the annular ring, along the top half of the button, and completely covering the top component covering the top half of the button.

The present invention further includes a button cover device for covering a button mounted to an object. The button has an outer perimeter edge together with a top half and a bottom half. The bottom half of the button is adjacent the object and the top half of the button is distant from the object. The button cover device comprises a C-shaped base component having a curved first arm and a curved second arm with both the first arm and the second arm have a top edge and a bottom edge. A top component is hingedly secured to the base component with the top component including a cover portion having a top surface and a bottom surface and an annular ring having a top edge and a bottom edge. The top edge of the annular ring is connected to the bottom surface of the cover portion with the annular ring extending in a general direction away from the bottom surface of the cover portion. A shoulder portion extends from the bottom edge of the first arm in a general direction toward the second arm and from the bottom edge of the second arm in a general direction toward the first arm. Upon sliding the first arm and the second arm of the base component around the outer perimeter edge of the button, along the bottom half of the button, the first arm and the second arm move in a general direction away from each other as the base component goes around the button and then automatically returning to its original position releasably grasping the button. The shoulder portion of the first arm and the second arm is positionable beneath the button, between the button and the object. Upon folding the top component over the button, the annular ring surrounds the outer perimeter edge of the button, along the top half of the button, with the top component covering at least a portion of the top half of the button.

DETAILED DESCRIPTION OF THE INVENTION

Figure 1:
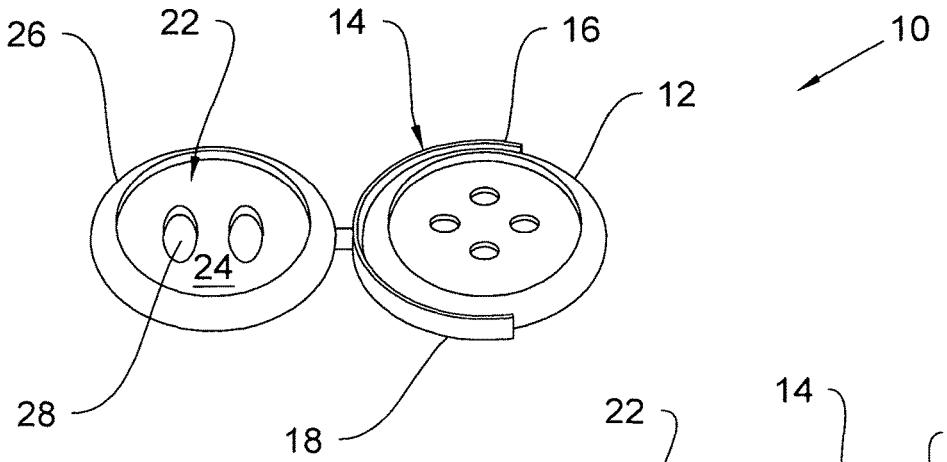
FIG. 1 is a perspective view illustrating a button cover device, constructed in accordance with the present invention, in the form of a solid colored button cover in an opened position being applied to an existing button.
Figure 2:
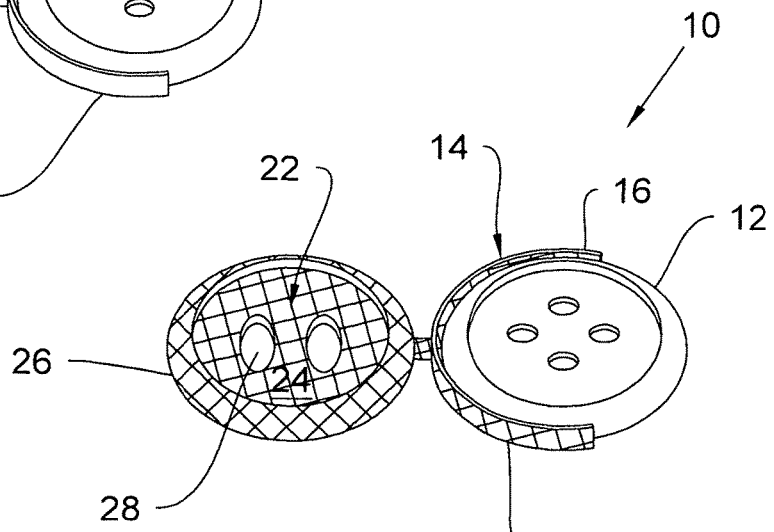
FIG. 2 is another perspective view illustrating the button cover device, constructed in accordance with the present invention, in the form of a solid colored button cover in an opened position being applied to an existing button.
Figure 3:
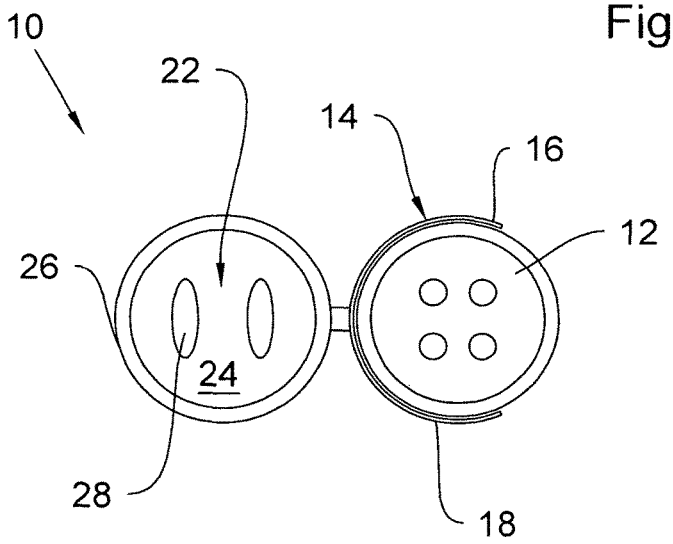
FIG. 3 is a top plan view illustrating the button cover device, constructed in accordance with the present invention, in the form of a faux stone colored button cover in an opened position being applied to an existing button.
Figure 4:
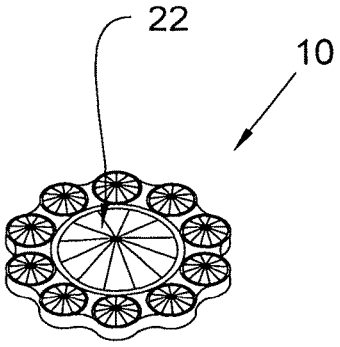
FIG. 4 is a perspective view illustrating the button cover device, constructed in accordance with the present invention, in the form of a gem embellished button cover in a closed position around an existing button.
Figure 5A:
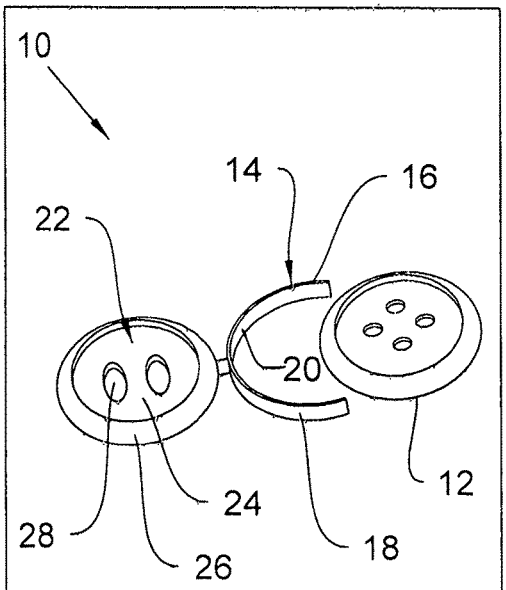
FIGS. 5*a*-5*d* are perspective views illustrating a functional series of steps of applying a base component of the button cover device, constructed in accordance with the present invention, around an existing button to clasp an outer perimeter edge of the existing button while a top component of the button cover device, which is integrally attached to the base component, snaps and securely fits over the top of the existing button while connectably touching a top of the base component of the button cover device.
Figure 5B:
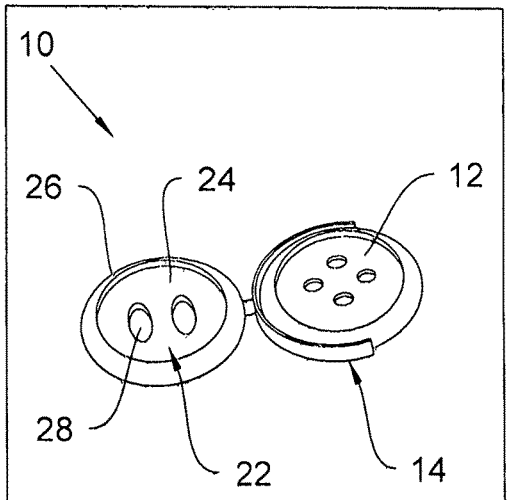
Figure 5C:
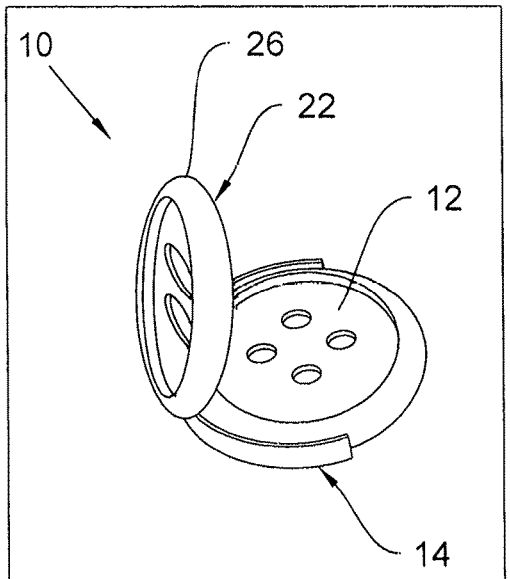
Figure 5D:
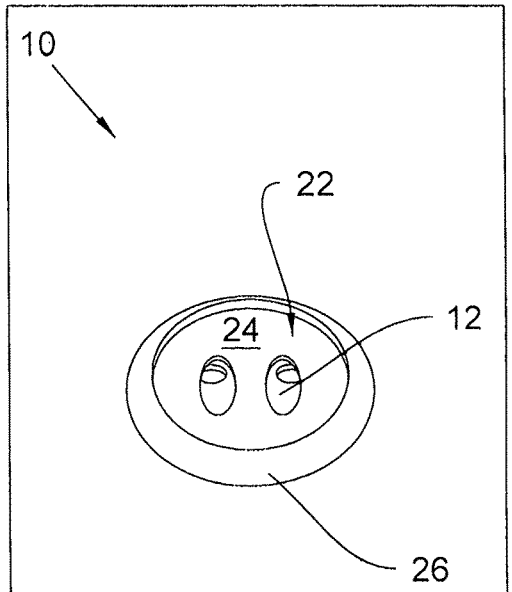
Figure 6:
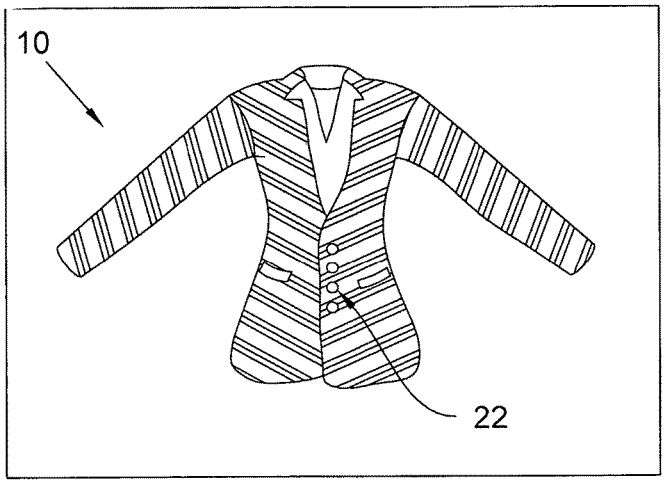
FIG. 6 is a perspective view illustrating the button cover device, constructed in accordance with the present invention, in the form of a set of approximately four button covers applied to the buttons running down the front of a stylish blazer for women.
Figure 7:
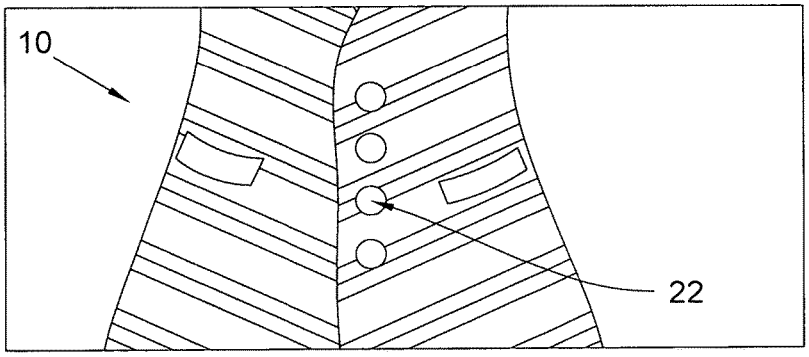
FIG. 7 is an elevational front view illustrating the button cover device of FIG. 6, constructed in accordance with the present invention, in the form of a set of approximately four button covers applied to the buttons running down the front of a stylish blazer for women.
Figure 8:
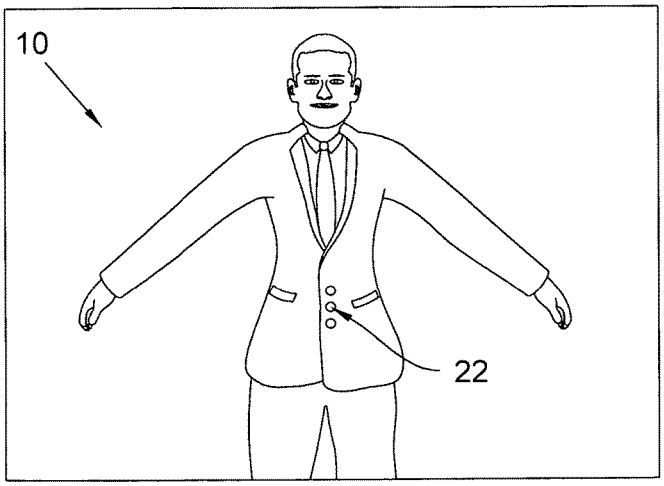
FIG. 8 is a perspective view illustrating the button cover device, constructed in accordance with the present invention, in the form of a set of approximately three button covers applied to the buttons running down the front of a suit blazer for men.

The present invention, hereinafter referred to as a Button Cover Device, indicated generally at 10, is a line of interchangeable button covers that provide individuals with a means of achieving variety and individuality within their wardrobe. The Button Cover Device 10 is a button cover configured to clamp onto an existing button 12 and releasably secured in position. The Button Cover Device 10 is usable on virtually any item with existing buttons 12 including clothing, handbags, and pillows.

The Button Cover Device 10 of the present invention includes a base component 14. The base component 14 is substantially C-shaped having a curved first arm 16 and a curved second arm 18. Both the first arm 16 and the second arm 18 have a top edge and a bottom edge substantially opposite the top edge. A shoulder portion 20 extends from the bottom edge of the first arm 16 in a general direction toward the second arm 18 and from the bottom edge of the second arm 18 in a general direction toward the first arm 16.

The base component 14 of the Button Cover Device 10 of the present invention is preferably constructed from a flexible and resilient material allowing the base component 14 to conform to the shape of the existing button 12 to be releasably secured to the existing button 12 around the outer perimeter edge of the existing button 12, along a bottom half of the existing button 12. To accomplish releasable securement, preferably, the first arm 16 and the second arm 18 of the base component 14 slide around the outer perimeter edge of the existing button 12 with the first arm 16 and the second arm 18 moving in a general direction away from each other as the base component 14 goes around the existing button 12 and then automatically returns to its original position releasably grasping the existing button 12. The shoulder portion 20 of the first arm 16 and the second arm 18 is positioned beneath the existing button 12, between the existing button 12 and the garment or other object, to inhibit the Button Cover Device 10 from being dislodged from the existing button 12.

The first arm 16 and the second arm 18 of the base component 14 of the Button Cover Device 10 of the present invention preferably extend greater than half-way around the outer perimeter edge of the existing button 12. By extending the first arm 16 and the second arm 18 to a point more than half-way around the outer perimeter edge of the existing button 12 allows the first arm 16 and the second arm 18 of the base component 14 wrap around at least a portion of the existing button 12 thereby releasably securing the base component 14 to the existing button 12. It is within the scope of the present invention, however, for the first arm 16 and the second arm 18 of the base component 14 to extend only half-way around the outer perimeter edge of the existing button 12 or less than half-way around the outer perimeter edge of the existing button 12.

In addition, the Button Cover Device 10 of the present invention includes a top component 22 hingedly secured to the base component 14. The top component 22 has a cover portion 24 having a top surface and a bottom surface substantially opposite the top surface. The top component 22 further includes an annular ring 26 having a top edge and a bottom edge substantially opposite the top edge. The top edge of the annular ring 26 of the top component 22 is connected to the bottom surface of the cover portion 24 of the top component 22 with the annular ring 26 extending from the bottom surface of the cover portion 24. Additionally, the cover portion 24 of the top component can be solid or have apertures 28 formed therein allowing the existing button 12 to be seen and accessed through the apertures 28.

The annular ring 26 of the top component 22 of the Button Cover Device 10 of the present invention is preferably constructed from a flexible and resilient material such that as the top component 22 folds over the existing button 12, the annular ring 26 snugly fits around the outer perimeter edge of the existing button 12, along a top half of the existing button 12, conforming to the shape of the existing button 12 thereby releasably securing the top component 22 in place and refacing the existing button 12. In fact, the annular ring 26 grasps the top half of the existing button 12 in a clasp like manner over the top half of the existing button 12 allowing the cover portion 24 of the top component 22 to cover and reface the existing button 12.

When releasably secured about the existing button 12, preferably, the bottom edge of the annular ring 26 of the top component 22 of the Button Cover Device 10 of the present invention contacts the top edge of the bottom component 14 and the existing button 12 contacts the bottom surface of the cover portion 24 of the top component 22 although having the bottom edge of the top component 22 out of contact with the top edge of the bottom component 14 and/or the existing button 12 out of contact with the bottom surface of the cover portion 24 of the top component 22 when the Button Cover Device 10 is closed is within the scope of the present invention.

The cover portion 24 of the top component 22 of the Button Cover Device 10 of the present invention can be constructed in a variety of shapes including, but not limited to, round, square, or oval. Further, the cover portion 24 of top component 22 can be constructed in a vast array of colors, textures, materials from fabrics to fine metals as well as augmented with patterns, additions, and embellishments that include rhinestones, acrylic stones, beads and crystals. Further yet, the cover portion 24 of the top component 22 can be constructed in a variety of shapes and sizes, with a variety of embellishments providing an affordable and stylish means of achieving variety and individuality by instantly enhancing a wardrobe.

Use of the Button Cover Device 10 is very simple and straightforward. A user selects a set of Button Cover Devices 10 based on personal taste and preference. A young lady may accentuate her new sweater with a set of button covers comprised of multicolored rhinestones. A young man may opt for silver studs along the front of his jacket. The user simply slips the base component 14 of the Button Cover Device 10 around the existing button 12 and snaps the top component 22 over the existing button 12 to fit around the existing button 12. The garment instantly transformed into a particularly unique style.

With its fit and snap configuration, the Button Cover Device 10 of the present invention provides a secure hold when an accessory is affixed to the existing buttons 12 on clothing and other merchandise. The Button Cover Device 10 line of button covers facilitates a simple attaching and removing of a variety of button adornments, allowing users to easily mix and match patterns or sizes on any garment or item they choose. Eliminating the time consuming task of completely removing original buttons and sewing new buttons on one's apparel, the Button Cover Device 10 accessories add variety and upgrade style to one's wardrobe and décor.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims.

The invention claimed is:

1. A button cover device for covering a button mounted to an object, the button having an outer perimeter edge, the button having a top half and a bottom half, the bottom half of the button adjacent the object, the top half of the button distant from the object, the button cover device comprising:

a C-shaped base component having a curved first arm and a curved second arm, both the first arm and the second arm have a top edge and a bottom edge, the base component constructed from a flexible and resilient material allowing the first arm and the second arm of the base component to conform to the shape of the button; and a top component hingedly secured to the base component, the top component has a cover portion having a top surface and a bottom surface and an annular ring having a first edge and a second edge, the first edge of the annular ring being connected to the bottom surface of the cover portion with the annular ring extending in a general direction away from the bottom surface of the cover portion;

wherein upon positioning the base component around the outer perimeter edge of the button, along the bottom half of the button, the base component is releasably secured to the button; and wherein upon folding the top component over the button, the annular ring surrounds the outer perimeter edge of the button, along the top half of the button, the top component covering at least a portion of the top half of the button, the top component constructed from a flexible and resilient material, the annular ring fitting snugly around the outer perimeter edge of the button, along a top half of the button, conforming to the shape of the button.

2. The button cover device of claim 1 wherein the first arm and the second arm of the base component are slidable around the outer perimeter edge of the button with the first arm and the second arm moving in a general direction away from each other as the base component goes around the button and then automatically returning to its original position releasably grasping the button.

3. The button cover device of claim 1 and further comprising:

a shoulder portion extending from the bottom edge of the first arm in a general direction toward the second arm and from the bottom edge of the second arm in a general direction toward the first arm;

wherein the shoulder portion of the first arm and the second arm is positionable beneath the button, between the button and the object.

4. The button cover device of claim 1 wherein the first arm and the second arm of the base component extend greater than half-way around the outer perimeter edge of the button.

5. The button cover device of claim 1 wherein the first arm and the second arm of the base component extend only half-way around the outer perimeter edge of the button.

6. The button cover device of claim 1 wherein the first arm and the second arm of the base component extend less than half-way around the outer perimeter edge of the button.

7. The button cover device of claim 1 wherein upon releasably securing the top component over the button, the second edge of the annular ring of the top component contacts the top edge of the bottom component.

8. The button cover device of claim 1 wherein upon releasably securing the top component over the button, the button contacts the bottom surface of the cover portion of the top component.

9. A button cover device for covering a button mounted to an object, the button having an outer perimeter edge, the button having a top half and a bottom half, the bottom half of the button adjacent the object, the top half of the button distant from the object, the button cover device comprising:

a C-shaped base component having a curved first arm and a curved second arm, both the first arm and the second arm have a top edge and a bottom edge, the base component constructed from a flexible and resilient material allowing the first arm and the second arm of the base component to conform to the shape of the button;

a top component hingedly secured to the base component, the top component has a cover portion having a top surface and a bottom surface and an annular ring having a top edge and a bottom edge, the top edge of the annular ring being connected to the bottom surface of the cover portion with the annular ring extending in a general direction away from the bottom surface of the cover portion, the annular ring of the top component is constructed from a flexible and resilient material, the annular ring fitting snugly around the outer perimeter edge of the button, along a top half of the button, conforming to the shape of the button;

a shoulder portion extending from the bottom edge of the first arm in a general direction toward the second arm and from the bottom edge of the second arm in a general direction toward the first arm;

wherein upon sliding the first arm and the second arm of the base component around the outer perimeter edge of the button, along the bottom half of the button, the first arm and the second arm moving in a general direction away from each other as the base component goes around the button and then automatically returning to its original position releasably grasping the button;

wherein the shoulder portion of the first arm and the second arm is positionable beneath the button, between the button and the object; and wherein upon folding the top component over the button, the annular ring surrounds the outer perimeter edge of the button, along the top half of the button, the top component covering at least a portion of the top half of the button.

10. The button cover device of claim 9 wherein the first arm and the second arm of the base component extend greater than half-way around the outer perimeter edge of the button.

11. The button cover device of claim 9 wherein upon releasably securing the top component over the button, the button contacts the bottom surface of the cover portion of the top component.

* * * * *